United States Patent [19]

Cheng et al.

[11] Patent Number: 4,568,325

[45] Date of Patent: Feb. 4, 1986

[54] BREAKAWAY BASE FOR AN ULTRACENTRIFUGE ROTOR

[75] Inventors: David W. W. Cheng, San Mateo; Steven J. Chulay, Los Altos, both of Calif.

[73] Assignee: Beckman Instruments, Inc., Fullerton, Calif.

[21] Appl. No.: 641,366

[22] Filed: Aug. 16, 1984

Related U.S. Application Data

[63] Continuation of Ser. No. 541,189, Oct. 12, 1983, abandoned, which is a continuation-in-part of Ser. No. 401,482, Jul. 26, 1982, abandoned.

[51] Int. Cl.[4] ..... B04B 9/00

[52] U.S. Cl. ..... 494/84; 74/572; 74/573 R; 415/9; 494/16

[58] Field of Search ..... 494/9, 8, 7, 12, 16, 494/81, 84, 85, 37, 60, 82; 366/220; 74/814, 572, 573; 415/9

[56] References Cited

U.S. PATENT DOCUMENTS

| | | | |
|---|---|---|---|
| 1,569,487 | 1/1926 | Harris . | |
| 2,666,572 | 1/1954 | Pickels | 494/9 |
| 3,101,322 | 8/1963 | Stallman | 494/9 |
| 3,961,745 | 6/1976 | Wright | 494/9 |
| 3,990,633 | 11/1976 | Stahl | 494/9 |
| 4,101,070 | 7/1978 | Hoare | 494/84 |

FOREIGN PATENT DOCUMENTS

| | | |
|---|---|---|
| 2231262 | 12/1974 | France . |
| 2306747 | 11/1976 | France . |

*Primary Examiner*—Robert W. Jenkins

*Attorney, Agent, or Firm*—W. H. May; P. R. Harder; S. R. Markl

[57] ABSTRACT

A breakaway base for use with an ultracentrifuge rotor wherein the base is designed to fracture when the rotor is above a specified speed so that the rotor will disengage from the drive spindle of the centrifuge. The base has cutout areas to establish a high stress region that is designed to fracture above a specified rotor speed. The cutout areas are designed to receive lugs projecting from the bottom of the rotor. The cutout areas have slotted ledges through which fastening bolts connect to the lugs on the rotor. The fracture of the base in the high stress region in conjunction with the slotted ledges will result in the base fracturing into two parts which will cause rotor disengagement from the drive spindle of the centrifuge and prevent the rotor from spinning at a greater speed.

20 Claims, 5 Drawing Figures

BREAKAWAY BASE FOR AN ULTRACENTRIFUGE ROTOR

This patent application is a continuation of application Ser. No. 541,189, filed Oct. 12, 1983, now abandoned, which is a continuation-in-part application of patent application Ser. No. 401,482, filed July 26, 1982, now abandoned, for Breakaway Base for an Ultracentrifuge Rotor.

BACKGROUND OF THE INVENTION

The present invention is directed to ultracentrifuge rotors and, more particularly, is directed to a mechanical overspeed protection device in the form of a breakaway base on an ultracentrifuge rotor.

Ultracentrifuge rotors are designed to withstand stresses within specified limits. The centrifuges into which the rotors are placed in many instances have a capability of imparting rotational speeds greater than the design limits of the rotor. Typically incorporated into centrifuge machines are electrical overspeed protection circuits that should cause the centrifuge to cease operation if a preset speed is exceeded; however, these devices are not infallible. Therefore, in certain cases, the speed-limiting device should be an intrinsic part of the rotor itself.

If a rotor should exceed its design speed, the G forces on the rotor in the primary stress areas may cause fracturing of the rotor and rapid dissipation of the kinetic energy of the rotor. This not only causes damage to the rotor and the centrifuge, but also presents a possibly hazardous condition to the users of the centrifuge. Typically, centrifuges are designed to contain any physical fracturing of the rotor. However, damage to the rotor and the centrifuge would be minimized if there are limits on the speed at which the rotor can operate.

The Stahl et al. U.S. Pat. No. 3,990,063 patent discloses a mechanical overspeed device for an ultracentrifuge rotor. Incorporated in this design is a hub member on which the rotor resides for connection to the drive spindle. The hub is connected to the rotor by use of bolts that extend through the hub member and into the body of the lower portion of the rotor. Slots are formed in the hub member to establish a stress area. The hub is connected by the bolts through apertures in the hub to the rotor. During high speed centrifugation, if the specified safe speed is exceeded, stress in the areas adjacent the slots will develop sufficiently to cause a fracture in the hub member. However, the bolts must be sheared in order to allow complete disengagement of the hub member. Further, the insertion of the bolts completely into the body of the rotor creates additional stress regions that may be the source of eventual fracturing in the rotor itself.

Another approach to a mechanical overspeed protection device is shown in the Wright U.S. Pat. No. 3,961,745 patent. This device utilizes a handle on top of the rotor which will rupture if the rotor exceeds a certain speed. The resulting imbalance to the rotor will cause the rotor to disengage from the drive shaft.

Another type of mechanical overspeed device is shown in the Stallman et al. U.S. Pat. No. 3,101,322 patent wherein a pin is designed to move radially outward in the event of an overspeed condition and engage electrical connector to stop the rotor. In the Pickels U.S. Pat. No. 2,666,572 patent a similar arrangement is shown having a different shaped pin which is designed to move radially outward and engage a stop switch in the event of a rotor overspeed.

The desire to have a mechanical overspeed protection device on an ultracentrifuge rotor, in addition to electrical overspeed protection circuits, becomes more pertinent with respect to very high speed ultracentrifuges which are operating in the range of 30,000 to 100,000 RPM. In many instances these rotors are capable of attaining kinetic energies exceeding one-half million foot-pounds. Therefore, it is desirable to have a mechanical overspeed protection device which will prevent a rotor from reaching a speed at which a possible hazardous condition could occur.

SUMMARY OF THE INVENTION

The present invention is directed to a mechanical overspeed protection device for attachment to an ultracentrifuge rotor. The device utilizes a breakaway base that has cutout areas to establish a fracture path or zone in the base if the rotor should exceed a specified speed. The breakaway base is a means for connecting the drive spindle of the centrifuge with the rotor. A pair of projecting lugs on the bottom of the rotor interconnect with the breakaway base. The cutout areas have slotted ledges through which the fastening bolts pass for connection to the rotor lugs. The slots on the ledges are designed to align with the fracture path of the hub so that, if a fracture should occur in the hub, it will be in alignment with the slots on the ledges of the cutout area. The bolts do not have to be sheared to permit disengagement of the rotor from the drive spindle.

If the rotor should achieve a speed above a specified safe operating speed, the base is designed to fracture and separate from the drive hub as well as from the rotor. Consequently, the drive spindle/rotor interface is destroyed and the rotor is prevented from developing higher speed and energy levels greater than that which can be contained by the centrifuge.

The present invention provides advantages over systems existing in the art. The fastening bolts are designed to enter the projecting lugs in the rotor and not the main body of the rotor. Therefore, the integrity of the rotor is retained and additional high stress areas are not created in the rotor which may be a source of damage to the rotor in subsequent runs in the centrifuge. The stress concentrations inside the rotor body are eliminated.

The use of the lugs that project from the rotor into the base also provides a means for transmitting the rather considerable torque that is applied when the tube cavity plugs are secured onto and loosened from the rotor body. During this operation the rotor base is normally held in a vise which serves to counteract the applied torque.

The present invention is designed so that the peak stress will occur on the innermost surface of each of the cutout areas. This is accomplished by slotting the ledges in the cutout area and leaving only one fracture zone on each side of the drive hole. Consequently, the highest stresses are made to occur in a region that is relatively simple to analyze. Hence, the intentional fractures can be more consistently predicted to facilitate the design of bases for various rotors.

The concept of using an attached base on the rotor allows for easier repair of some rotors which have been damaged as a result of drive failure. Since only the rotor bottom is typically damaged when the rotor is disengaged from the drive spindle, the present invention allows for the easy replacement of a damaged base which is a much more simplified and less costly step than rematching the spindle drive hole in a rotor.

Similarly, it must be noted that one of the high stress zones in an ultracentrifuge rotor is the region around the drive hole. Normally, the deeper this recess projects inside the rotor body, the higher the stress will be. By eliminating or reducing the depth of the drive hole, the rotor can be made stronger. Consequently, the use of the attached base will eliminate a drive hole in the rotor body.

DETAILED DESCRIPTION OF THE INVENTION

Figure 1:
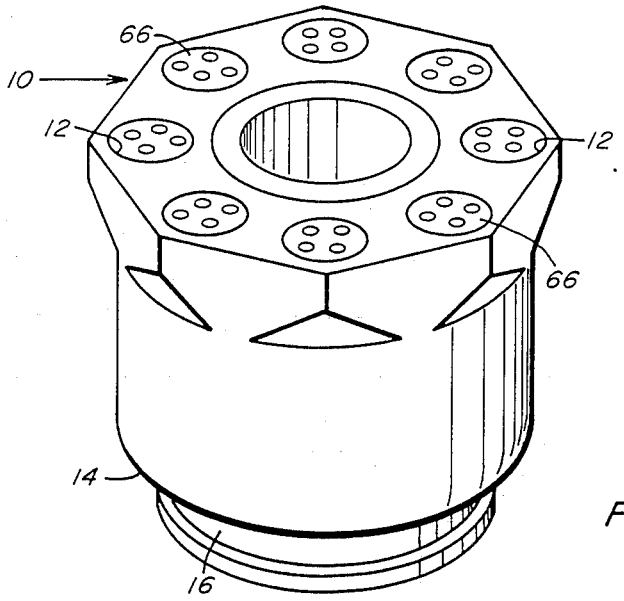
FIG. 1 is a perspective view of a vertical tube ultracentrifuge embodying the present invention.

The centrifuge rotor 10 in FIG. 1 represents an ultracentrifuge rotor typically known as a vertical tube rotor in that the tube cavities 12 are oriented generally parallel to the spin axis of the rotor in a vertical direction. The rotor 10 is typically made of a very strong metal such as titanium, machined to precise dimensions and configurations, and accurately balanced to withstand tremendous G loads under high speed rotation. Attached to the lower surface 14 of the rotor 10 is a removable or breakaway base 16.

Figure 4:
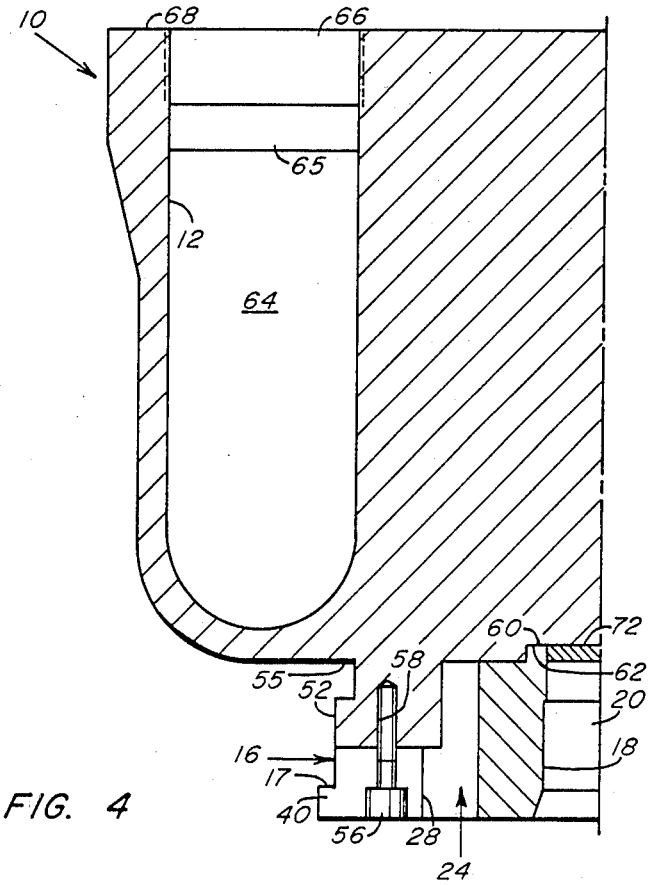
FIG. 4 is a partial sectional view of the present invention showing the breakaway base connected to the rotor.
Figure 3:
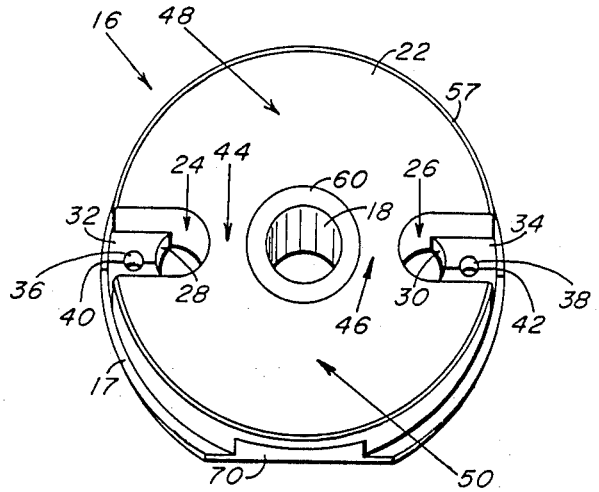
FIG. 3 is a perspective view of the breakaway base of the present invention.

Attention is directed to FIG. 3 showing the breakaway base 16 which has a general cylindrical configuration with a lower lip 17. As shown in FIG. 4, the base 16 has a central cavity 18 for receipt of a drive spindle hub 20. Located 180° apart and in alignment with each other in the base 16 in FIG. 3 are cutout areas 24 and 26. Included in each of these cutout areas 24 and 26 are respective through apertures 28 and 30. Further, located in each of the respective cutout area 24 and 26 are respective ledges 32 and 34 which have respective fastening apertures 36 and 38. Respective slots 40 and 42 are located in the ledges 32 and 34 and are oriented in planar alignment with each other, the center of the base, and the center of each of the fastening apertures 36 and 38.

Located between the respective cutout areas 24 and 26 are high stress regions 44 and 46. The existence of the slots 40 and 42 and the apertures 28 and 30 results in the regions 44 and 46 being subjected to high stress during high speed centrifugation. During centrifugation, the stress experienced by the regions 44 and 46, which are located adjacent the drive hub cavity 18 in the base 16, is significantly greater than the stress on comparison to the larger areas 48 and 50 of the base 16 in FIG. 3.

Figure 2:
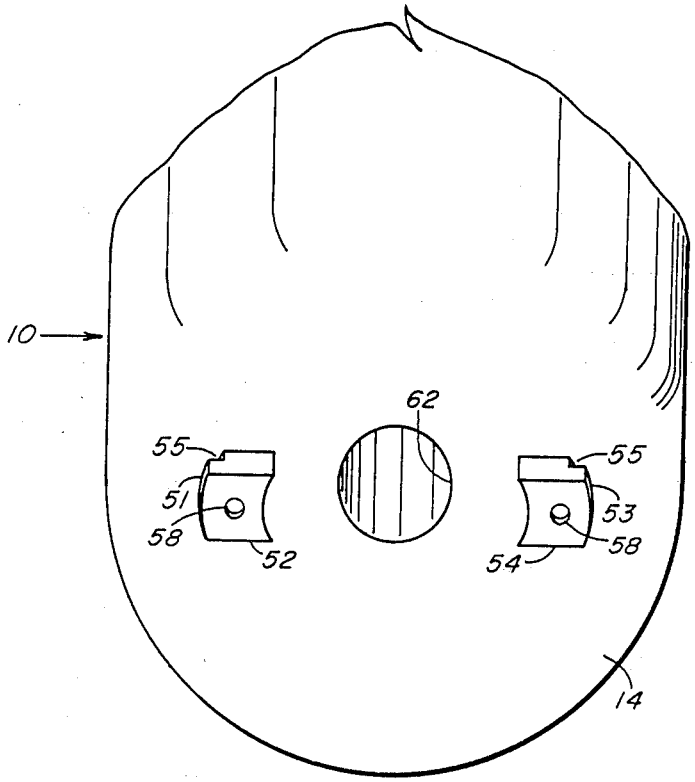
FIG. 2 is a perspective view of the bottom of the rotor in FIG. 1 showing a portion of the present invention.

In FIG. 2, the bottom 14 of the rotor 10 has projecting lugs 52 and 54 which are designed to seat within the cutout areas 24 and 26 of the base 16. When the lugs 52 and 54 are positioned within the cutout areas 24 and 26, any rotational motion imparted to the drive hub 20 by the drive shaft will in turn be imparted to the rotor 14. As shown in FIG. 4, the lug 52 (as well as the lug 54 not shown) is designed to be of a thickness sufficient enough to accommodate the length of a fastening bolt 56 which is inserted through the fastening hole 36 of the ledge 32 in the base 16. The aperture 58 of the fastening bolt 56 in the lug 52 is not deep enough to enter into the rotor body portion 10. This is important so that no additional high stress concentration areas are created inside the rotor body.

Located at the interface between the outside faces 51 and 53 of the respective lugs 52 and 54 and the bottom 14 of the rotor are notches 55 to permit turned surface machining of a band approximately the depth of the notch toward the center of the rotor. This area or band will mate with the slight raised rim 57 on the top surface 22 of the breakaway base which is also a machined turned surface. Since the rim 57 is slightly higher than the remainder of the base, only the rim will contact the bottom of the rotor. This will eliminate any slight out of flatness which might otherwise occur if the whole surface of the base contacted the bottom of the rotor.

With respect to FIG. 3, a locating boss rim 60 is positioned on the upper surface 22 and around the central cavity 18 of the base 16. The locating boss is designed to be received in the locating recess 62 in bottom 14 of the rotor 10 in FIG. 2. This will assist in the orientation of the rotor 10 in conjunction with the base 16 for the proper orientation of the lugs 52 and 54 in the cutout areas 24 and 26.

Figure 5:
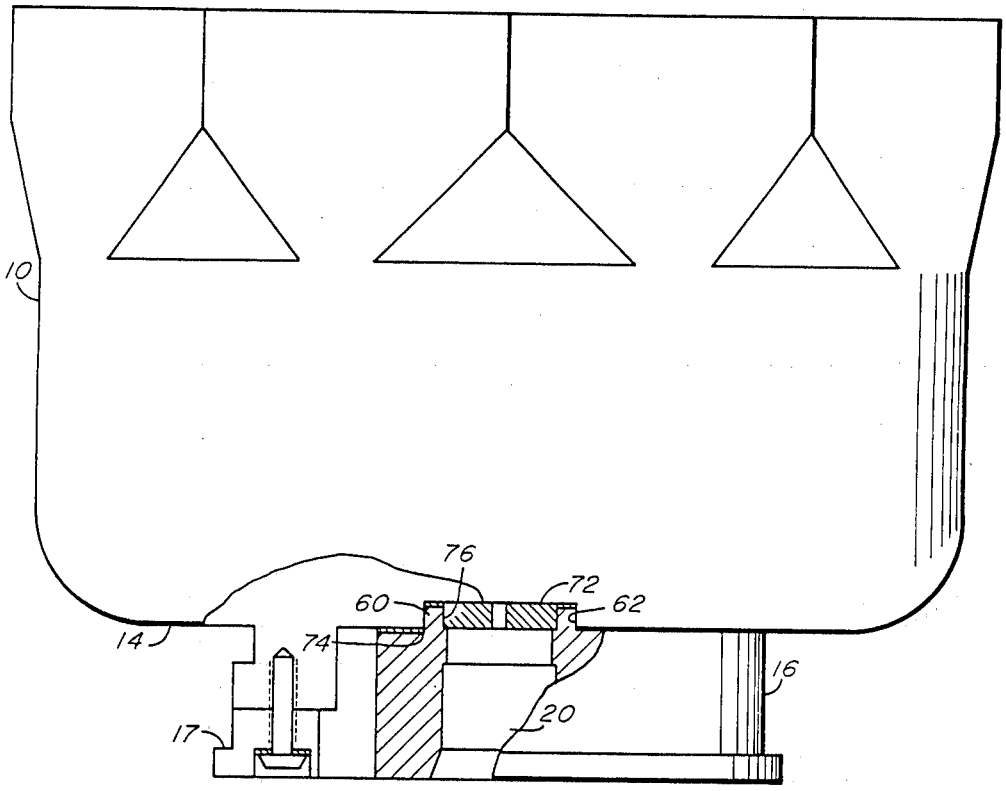
FIG. 5 is a side view of the breakaway base and rotor shown partially in section.

As shown in FIG. 5, an insert member 72 is placed within the locating rim 60 to support the rim 60 so that in the event the rotor exceeds a specified speed and the base fractures, the locating rim 60 will shear at its interface with the shoulder 74 in the rotor body adjacent the recess 62. The insert 72 is a generally cylindrical disc member which is designed to be placed in close contact with the interior surface 76 of the locating rim 60. The significance of the insert 72 is that it will promote the shearing of the locating rim 60 rather than permitting the rim to collapse or bend inward when the base is fracturing as a result of excessive rotor speed. The inward collapsing of the rim 60 would result in a downward force on moving the breakaway base as it fractures with the resultant reactive upward force on the rotor. This may cause the rotor to possibly move upward rather than just disengaging from the drive hub and falling into the rotor chamber. It is preferable to limit any disengagment of the rotor to a downward direction into the containment chamber of the centrifuge rather than upward toward the centrifuge door which encloses the rotor chamber.

Turning to the operation of the present invention, attention is directed to FIG. 4. The rotor 10 has the breakaway base 16 attached with the fastening bolts 56. A centrifuge tube 64 is placed within the tube cavity 12 of the rotor 10. Once the tube 64 is in place, a spacer 65 (not shown in section) is placed on top of the tube to support the upper portion of the tube. A plug 66 (not shown in section) is threaded into the tube cavity 12 adjacent the top surface 68 of the rotor 10 to secure the spacer and tube. Torqueing of the plug 66 is accomplished by placing of the rotor/base assembly with the rotor base 16 placed in a rotor vise. The small holes 67 in the top of each plug 66 in FIG. 1 are for receipt of a tool to torque down the plugs. The flat surface 70 shown in FIG. 3 on the base 16 as well as a similar flat surface (not shown) located 180° from the flat space 70 are aligned with conforming flat surfaces in a rotor vise. The rotor will not move as the plug 66 is torqued down tightly in the tube cavity 12. The torque action is resisted by the lugs 52 and 54 being in the cutout areas 24 and 26 of the base 16 which in turn is held in the rotor vise (not shown) by the flat surfaces 70 in the base 16.

After all the centrifuge tubes 64, spacers 65, and plugs 66 have been assembled in the rotor 10, the rotor is removed from the rotor vise and placed in the centrifuge maching wherein the drive hub 20 in FIG. 4 of the drive spindle (not shown) is received in the cavity 18 in the base 16.

During normal centrifugation operation the drive hub 20 in FIG. 4 will rotate and impart rotational motion into the base 16 as well as the rotor 10. The rotor is designed to operate at a specified maximum speed to ensure safe operation. However, if the speed should exceed the maximum safe speed, fracture of the rotor could result in the rapid dissipation of unacceptably high kinetic energy.

The present invention provides a mechanical device to prevent overspeed by automatically disengaging the rotor from the drive hub 20 if the actual speed should happen to exceed the design maximum operational speed. The base 16 has been specifically designed to establish high stress regions 44 and 46 which, during speed above the maximum operational speed, will be subjected to tremendous stress as a result of the centrifugal forces generated. These regions are specifically designed to fracture at speeds above the maximum operational speed, so that the base will separate into two parts 48 and 50. The cutaway areas 24 and 26 with the slots 40 and 42 in the ledges 32 and 34 provide for this separation. Once the stress areas 44 and 46 fracture, the parts 48 and 50 will separate away from the fastening bolts 56 which do not need to be sheared before the base can be disengaged from the drive hub and the rotor. Once the cutaway areas 24 and 26 cease to exist as a result of the base breaking into two parts 48 and 50, the projecting plugs 52 and 54 will no longer be supported and receive rotational motion from the drive hub. The rotor will fall off of the drive hub into the rotor chamber. The only damage which may occur is damage to the rotor itself and to the interior of the centrifuge rotor chamber.

As previously discussed with respect to FIG. 5, the support insert 72 located within the locating rim 60 of the breakaway base provides the necessary support to the locating rim 60 so that during an overspeed condition in the rotor wherein the stress areas 44 and 46 of the base fracture, the rim 60 will be prevented from bending inward so that it will fail in shear, allowing the fractured two main portions 48 and 50 of the breakaway base to move horizontally away from the drive hub. This prevents any downward directed motion of the portions of the fracture base and eliminates any reactive opposite upward force on the rotor which may tend to move the rotor upward and out of the desired containment area of the rotor chamber. Once the locating rim 60 is sheared and the fractured portions of the base move horizontally away from the drive hub, the insert 72 will fall off of the drive hub as will the rotor.

Because the fastening bolts 56 extend only into the lugs 52 and 54, there is no penetration into the rotor body which would otherwise create an area of high stress concentration during high speed ultracentrifugation. In addition, the fact that the rotor does not have a large cavity for receipt of the drive hub of the drive spindle, no stress concentrations will occur in the lower center of the rotor. The majority of the major stress concentration during centrifugation is by design limited to the lugs 52 and 54 and the base 16.

The present invention provides a positive way to prevent the rotor from overspeeding and developing excessive energy. The elimination of the high stress region associated with a drive hole in the center of the rotor itself reduces the possibility of the rotor failing through its center which is the worst type of failure in a high speed rotor.

Because of the removable breakaway base 16, the rotor can be easily repaired by the replacement of the base in the event that the rotor would jump the drive hub as a result of possible excessive imbalance in the rotor or in the case of drive seizure. This is much more efficient and less costly than having to remachine a rotor drive hole which would be located in the bottom of the rotor.

It is envisioned that embodiments of a breakaway base for an ultracentrifuge rotor other than that specifically shown in this application could be designed within the scope and spirit of the present invention. 9n

What is claimed is:

1. A centrifuge rotor for placement in an ultracentrifuge, said rotor comprising:

a rotor body for carrying samples to be centrifugated;

a breakaway base designed for connection with rotor drive means in said centrifuge;

means projecting from said rotor body for engaging said base with said rotor body;

means for securing said base to said rotor body; and means formed in said base for reducing the cross-sectional area of said base in specified locations, said cross-sectional area reducing means causing said base to fracture adjacent said locations and disengage said rotor from said drive means and said securing means when said rotor exceeds a specified speed.

2. A centrifuge rotor as defined in claim 1, wherein said engaging means comprises at least two lugs.

3. A centrifuge rotor as defined in claim 2, wherein said cross-sectional area reducing means comprises at least a pair of cutout areas in said base, said lugs being positioned in said cutout areas.

4. A centrifuge rotor as defined in claim 3, wherein each of said cutout areas comprises a slotted ledge.

5. A centrifuge rotor as defined in claim 4, wherein said securing means comprises fastening bolts positioned through said slotted ledges and into said lugs, said slotted ledges being oriented 180° from each other on opposite sides of the center of said breakaway base, said base fracturing through its center and in alignment with said slots in said ledges.

6. A centrifuge rotor as defined in claim 1, wherein said securing means comprises a fastener being attached to said engaging means and not contacting said rotor body.

7. A centrifuge rotor as defined in claim 1, wherein said base comprises a generally cylindrical member having a central cavity for receipt of the drive means of said ultracentrifuge.

8. A centrifuge rotor as defined in claim 1, wherein said base comprises a generally cylindrical member having two vertical noncylindrical sides at different annular positions around said cylindrical base.

9. A centrifuge rotor as defined in claim 1, and additionally comprising means on said base for providing a uniform flat contact between said base and said rotor body.

10. A centrifuge rotor as defined in claim 9, wherein said uniform flat contact providing means comprises a raised rim on said base having a turned surface produced by machining.

11. A centrifuge rotor as defined in claim 1, and additionally comprising means on said base for locating said base in alignment with said rotor body.

12. A centrifuge rotor as defined in claim 11 wherein said locating means comprises a circular raised rim on said base, said rim being received in a recess within said rotor body.

13. A centrifuge rotor as defined in claim 12 and additionally comprising a rim supporting member located within said rim to support said rim so that it will shear off of said base when said rotor exceeds said specified speed and said base fractures.

14. A rotor for use in an ultracentrifuge having a drive spindle, said rotor comprising:

a rotor having a lower surface;

at least two lugs projecting from said lower surface;

a breakaway base connected to said rotor lower surface, said base having at least two cutout areas on opposite sides of the center of said base and in alignment with each other, said lugs positioned in said cutout areas, said base in driving engagement with said drive spindle;

means for fastening said base to said lugs; and means within said cutout areas for forming a ledge to receive said fastening means, said ledge forming means having slots, said base fracturing between said cutout areas when said rotor exceeds a specified speed, said slots allowing said fractured base to detach from said fastening means and disengage said rotor from said drive spindle.

15. A centrifuge rotor as defined in claim 14 and additionally comprising:

a central circular locating rim on said base, said rotor lower surface having a recess for receipt of said rim; and a cylindrical insert within said rim to support said rim and cause said rim to shear from said base when said rotor exceeds said specified speed and said base fractures.

16. A centrifuge rotor comprising:

a rotor body having a top surface with cavities for receipt of samples and a bottom surface;

at least two lugs projecting from said bottom surface of said rotor body;

a breakaway base for engagement with a drive means;

means in said breakaway base for receiving said lugs in such a manner that rotation of said breakaway base will cause rotation of said rotor body; and means for securing said base to said rotor body, said securing means extending through said breakaway base and into said projecting lugs, said securing means not extending into said bottom surface of said rotor body, said breakaway base fracturing into at least two parts when said rotor rotates above a specified speed, said breakaway base disengaging from said drive means and said securing means when said base fractures.

17. A rotor for an ultracentrifuge having a central drive spindle with a hub for receipt of said rotor, said rotor comprising:

a rotor body designed for carrying samples for centrifugation;

at least two projecting lugs on the bottom of said rotor body;

a generally cylindrical breakaway base attached to said rotor, said base having at least two outer apertures in alignment with each other and the center of said base, said apertures establishing narrow areas adjacent said center of said base, said projecting lugs positioned in said apertures; and means for securing said base to said rotor body, said narrow areas designed in such a manner that they will fracture when said rotor exceeds a specified speed, causing said base to break away from said rotor body, said securing means remaining in place when said base breaks.

18. A centrifuge rotor comprising:

a rotor body for carrying samples to be centrifugated, said rotor body having a recess in its lower surface;

a breakaway base for connection to rotor drive means, said base having a circular raised rim for receipt in said recess of said rotor body;

means for securing said base to said rotor body;

means formed in said base for reducing the cross-sectional area of said base in specified locations to cause said base to fracture adjacent said locations and disengage said rotor from said drive means and said securing means when said rotor exceeds a specified speed; and means positioned within said rim for supporting said rim so that it will fail and shear when said base fractures.

19. The centrifuge rotor as defined in claim 18, wherein said supporting means comprises a cylindrical insert member.

20. A centrifuge rotor as defined in claim 19, wherein said insert member is closely adjacent and within said circular rim.

* * * * *